US006942215B2

(12) United States Patent
Kang et al.

(10) Patent No.: US 6,942,215 B2
(45) Date of Patent: Sep. 13, 2005

(54) PAPER TRANSFERRING MECHANISM UTILIZING A SWING GEAR AND CONTROLLING METHOD THEREOF

(75) Inventors: Sin-kyu Kang, Seoul (KR); Kiel-jae Hur, Anyang (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 161 days.

(21) Appl. No.: 10/393,245

(22) Filed: Mar. 21, 2003

(65) Prior Publication Data

US 2004/0026849 A1 Feb. 12, 2004

(30) Foreign Application Priority Data

Aug. 7, 2002 (KR) ..... 2002-46653

(51) Int. Cl.[7] ..... B65H 7/02

(52) U.S. Cl. ..... 271/265.01; 271/264; 74/810.1

(58) Field of Search ..... 271/265.01, 264, 271/256, 258.02, 258.05, 272, 314; 74/63, 664, 810.1

(56) References Cited

U.S. PATENT DOCUMENTS 5,663,804 A * 9/1997 Kataoka et al. ..... 358/304
5,854,696 A * 12/1998 Yun ..... 358/498
5,892,594 A * 4/1999 Yoo ..... 358/498
6,073,923 A * 6/2000 Lin et al. ..... 271/10.03
6,485,011 B1 * 11/2002 Yen et al. ..... 271/10.03
2003/0002083 A1 * 1/2003 Jang et al. ..... 358/400

FOREIGN PATENT DOCUMENTS

| | | |
|---|---|---|
| JP | 05-092838 | 4/1993 |
| JP | 07-041193 | 2/1995 |
| JP | 08-157095 | 6/1996 |
| JP | 10-072139 | 3/1998 |

* cited by examiner

*Primary Examiner*—Donald P. Walsh
*Assistant Examiner*—Mark Beauchaine
(74) *Attorney, Agent, or Firm*—Staas & Halsey LLP

(57) ABSTRACT

The paper transferring mechanism includes a drive gear coaxially coupled with a rotation shaft of a motor, a pick-up gear coupled with a shaft of a pick-up roller to separately feed the paper sheets, and a feed gear coupled with a shaft of a feed roller to outwardly transfer the paper sheets. The paper transferring mechanism also includes a discharge gear coupled with a shaft of a discharge roller to outwardly discharge the paper sheets, and a swing gear having one end connected to the drive gear and the other end selectively connected to one of the pick-up gear and the feed gear. The pick-up gear is rotated when the motor is rotated in a first direction, the feed gear is rotated when the motor is rotated in a second direction, and the discharge gear is rotated constantly in one direction regardless of the rotation direction of the motor.

15 Claims, 4 Drawing Sheets

PAPER TRANSFERRING MECHANISM UTILIZING A SWING GEAR AND CONTROLLING METHOD THEREOF

CROSS-REFERENCE TO RELATED APPLICATION

This application claims the benefit of Korean Application No. 2002-46653, filed Aug. 7, 2002, in the Korean Intellectual Property Office, the disclosure of which is incorporated herein by reference.

BACKGROUND OF THE INVENTION

1. Field of the Invention

The present invention relates to an office machine that performs a specific operation of transferring paper sheets, and more particularly, to a paper transferring mechanism of an office machine to perform a specific operation of transferring paper sheets and a controlling method thereof.

2. Description of the Related Art

In general, office machines perform a specific operation of transferring paper sheets, reading information indicated on the paper sheets and transmitting or copying the read information. Facsimiles machines, copying machines, multifunction machines, etc., are examples of such office machines.

FIG. 1 is a view of a sheet transferring mechanism in a facsimile machines to show an example of an office machine to perform a specific operation of transferring paper sheets.

Referring to FIG. 1, the sheet transferring mechanism includes a drive gear 1, an Automatic Document Feeder (ADF) gear train 10, a feed gear train 20, a discharge gear train 30, and first and second sensors 41 and 42.

The drive gear 1 is coupled with a rotation shaft of a motor (not shown) while being meshed into an intermediate gear 3. The intermediate gear 3 is in the form of a double gear including two coaxially connected gears 4 and 5, which have different diameters of pitch circles.

The ADF gear train 10 includes an ADF gear 11 coaxially coupled with an ADF roller (not shown) and an ADF step gear 13. The ADF roller separately picks up the paper sheets stacked in a paper cassette (not shown) one by one and transfers each paper sheet toward a feed roller (not shown). The ADF step gear 13 at one side is meshed into the ADF gear 11 and at the other side meshed with the gears 4 and 5 of the intermediate gear 3.

The feed gear train 20 includes a feed gear 21 coaxially coupled with the feed roller and a feed end gear 23. The feed roller transfers the paper sheet, which is picked up by the ADF roller and transferred along a sheet course A, toward a scan unit 45. The feed end gear 23 is meshed at one side into the feed gear 21 and at the other side with the gears 4 and 5 of the intermediate gear 3.

The discharge gear train 30 includes a discharge gear 31, a first intermediate gear 33, a second intermediate gear 35 and a discharge end gear 36. The discharge gear 31 is coaxially coupled with a discharge roller (not shown) to discharge a sheet that is completely scanned. The first intermediate gear 33 and the second intermediate gear 35 are installed between the discharge gear 31 and the discharge end gear 36, and transmit a rotational force of the discharge end gear 36 into the discharge gear 31. The discharge end gear 36 is meshed at one side into the intermediate gear 3 and at the other side into the second intermediate gear 35.

The first sensor 41 is disposed in front of the feed roller on the sheet course A between the feed roller and the ADF roller to detect any sheet fed from the ADF roller. The second sensor 42 is disposed in the back of the feed roller on the sheet course A between the feed roller and the discharge roller to confirm whether the sheet past through the feed roller has been scanned or not.

Hereinafter, an operation of the sheet transferring mechanism as set forth above will be described in reference to FIG. 1.

When the drive gear 1 is rotated with the motor, the intermediate gear 3 meshed into the drive gear 1 is also rotated. The rotation of the intermediate gear 3 is transmitted into the ADF roller via the ADF gear train 10 meshed into the intermediate gear 3. That is, the rotational force of the motor is transmitted into the ADF gear 11 via the ADF step gear 13 meshed into the intermediate gear 3, causing the ADF roller coaxially coupled with the ADF gear 11 to rotate. The ADF roller rotates in a direction reverse to a rotation direction of the motor.

The feed gear train 20 and the discharge gear train 30 are also rotated. In the feed gear train 20, the feed gear 21 is rotated via the feed end gear 23 meshed into the intermediate gear 3, causing the feed roller coaxially coupled with the feed gear to rotate. The feed roller rotates in a direction reverse to the rotation direction of the motor.

In the discharge gear train 30, the discharge gear 31 is rotated via the discharge end gear 36 meshed into the intermediate gear 3 and the second intermediate gears 33 and 35 meshed into the discharge end gear 36, causing the discharge roller coaxially coupled with the discharge gear 31 to rotate. The discharge roller rotates in a direction reverse to the rotation direction of the motor.

Therefore, as the motor rotates clockwise, the ADF roller is rotated counterclockwise to pick up one of the sheets from its stacked position in the paper cassette and to displace the same toward the feed roller, which is also rotated counterclockwise along with discharge roller.

When the paper sheet transferred by the ADF roller activates the first sensor 41, the motor rotates counterclockwise. Accordingly, the feed roller is then rotated clockwise to transfer the paper sheet from the ADF roller toward the scan unit 45 disposed in the back of the feed roller. After passing over the scan unit 45 by the feed roller, the paper sheet is discharged out by the discharge roller which, at this time, is in a clockwise rotation like the feed roller. When a given time period lapses after the second sensor 42 detects the end of the paper sheet being transferred toward the scan unit 45, the motor rotates clockwise so that the ADF roller picks up another paper sheet from the paper cassette again. The above process allows information of the paper sheets stacked in the paper cassette to be read and successively transmitted or copied.

However, the above conventional paper transferring mechanism has a construction in that the feed roller and the discharge roller change rotation direction when the motor changes rotation direction, so that a new paper sheet may be picked up only after a previous one is completely discharged via the discharge roller. Accordingly, a pick-up interval between two adjacent paper sheets increases, prolonging time for facsimile transmission while reducing a number of paper sheets to be copied or scanned per minute.

SUMMARY OF THE INVENTION

Accordingly, it is an aspect of the present invention to provide a paper transferring mechanism to utilize a swing gear and a controlling method thereof, in which a discharge roller is continuously rotated in one direction regardless of a rotation direction of a motor, so that a new paper sheet is picked up before a complete discharge of a previous paper sheet. The paper transferring mechanism reduces pick-up time between two adjacent paper sheets, so that a number of paper sheets to be facsimile-transmitted, copied or scanned per minute is increased.

Additional aspects and advantages of the invention will be set forth in part in the description which follows and, in part, will be obvious from the description, or may be learned by practice of the invention.

The foregoing and/or other aspects of the present invention are achieved by providing a paper transferring mechanism to transfer a paper sheet including a drive gear coaxially coupled with a rotation shaft of a motor, a pick-up gear unit coupled with a shaft of a pick-up roller to feed the paper sheet, a feed gear unit coupled with a shaft of a feed roller to outwardly transfer the paper sheet and a discharge gear unit coupled with a shaft of a discharge roller to outwardly discharge the paper sheet. The paper transferring mechanism also includes a swing gear having one end connected to the drive gear and the other end selectively connected to one of the pick-up gear unit and the feed gear unit. A pick-up gear of the pick-up gear unit is rotated when the motor is rotated in a first direction, a feed gear of the feed gear unit is rotated when the motor is rotated in a second direction, and a discharge gear of the discharge gear unit is rotated constantly in one direction regardless of the rotation direction of the motor.

According to an aspect of the invention, the paper transferring mechanism includes a first sensor disposed between the pick-up roller and the feed roller to detect the paper sheet, and a second sensor disposed between the feed roller and the discharge roller to detect the paper sheet. The motor rotates in the second direction when the first sensor is activated, and the motor rotates in the first direction when the second sensor is activated.

The foregoing and/or other aspects of the present invention are achieved by providing a paper transferring mechanism to transfer a paper sheet including a drive gear coaxially coupled to a rotation shaft of a motor, a pick-up gear train to transmit power to a pick-up roller, a feed gear train to transmit power to a feed roller, a discharge gear train to transmit power to a discharge roller, and a swing gear train having one end connected to the drive gear and the other end selectively connected to one of the pick-up gear train and the feed gear train. The pick-up roller is rotated when the motor rotates in a first direction, the feed roller is rotated when the motor rotates in a second direction, and the discharge roller is rotated constantly in one direction regardless of the rotation direction of the motor so as to transfer the paper sheet.

According to an aspect of the invention, the paper transferring mechanism includes a first sensor disposed between the pick-up roller and the feed roller to detect the paper sheet, and a second sensor disposed between the feed roller and the discharge roller to detect the paper sheet. The motor rotates in the first direction when the second sensor is activated, and the motor rotates in the second direction when the first sensor is activated.

According to an aspect of the invention, the pick-up gear train includes a pick-up gear coaxially coupled with the pick-up roller, a pick-up intermediate gear meshed into the pick-up gear, and a pick-up end gear meshed into the pick-up intermediate gear and connected with the swing gear train. The pick-up gear is preferably in a form of a double gear.

According to an aspect of the invention, the feed gear train includes a feed gear coaxially coupled with the feed roller, a feed intermediate gear meshed into the feed gear and a feed end gear meshed into the feed intermediate gear and connected with the swing gear train.

According to another aspect of the invention, the discharge gear train includes a discharge gear coaxially coupled with the discharge gear, and a discharge end gear meshed into the discharge gear and connected with the swing gear train.

According to yet another aspect of the invention, the swing gear train includes a swing end gear meshed into the drive gear, a swing intermediate gear meshed into the swing end gear, a swing arm structure disposed coaxially with the swing intermediate gear and having three arms, and first, second, and third swing gears disposed, respectively, on ends of the arms of the swing arm structure to be meshed into the swing intermediate gear. The first swing gear is connected with the pick-up gear train and the second swing gear is connected with the discharge gear train when the motor rotates in a first direction. The first swing gear is connected with the feed gear train and the third swing gear is connected with the discharge gear train when the motor rotates in a second direction.

The foregoing and/or other aspects of the present invention are achieved by providing an office machine including a feed unit having stacked paper sheets, a motor having a rotation shaft coaxially coupled with a drive gear, a pick-up roller powered by the motor via a pick-up gear train, a feed roller powered by the motor via a feed gear train and a discharge roller powered by the motor via a discharge gear train. The office machine also includes a swing gear train having one end connected with the drive gear and the other end selectively connected to one of the pick-up gear train and the feed gear train. The office machine includes a first sensor disposed between the pick-up roller and the feed roller to detect a picked up one of the paper sheet, a scan unit disposed between the feed roller and the discharge roller to read information from the picked up paper sheet, and a second sensor disposed between the feed roller and the scan unit to detect the picked up paper sheet. A rotation of the motor in a first direction causes the swing gear train to mesh into the pick-up gear train and the discharge gear train, which respectively rotate the pick-up roller and the discharge roller, so that the picked up paper sheet is transferred from the feed unit toward the feed roller. The motor rotates in a second direction when the picked up paper sheet passes the first sensor, and the rotation of the motor in the second direction causes the swing gear train to reversely rotate and mesh into the feed gear and the discharge gear train to rotate the feed roller and the discharge roller. The motor rotates in the first direction again when an end of the picked up paper sheet passes the second sensor.

The foregoing and/or other aspects of the present invention are achieved by providing a controlling method of a paper transferring mechanism to selectively transmit power from a motor to one of a pick-up roller and a feed roller via a swing gear. The method includes rotating the motor clockwise, judging whether a first sensor operates, if the first sensor operates, then rotating the motor counterclockwise, judging whether a second sensor operates, and if the second sensor operates, then rotating the motor clockwise.

According to an aspect of the invention, the controlling method may further include judging whether a certain time period lapses after the second sensor is operated.

With the paper transferring mechanism utilizing the swing gear and the controlling method thereof as set forth above according to the present invention, since a new paper sheet is picked up before a previous one is not completely discharged, the pick-up time between two adjacent paper sheets is reduced, increasing a number of paper sheets to be facsimile-transmitted, copied or scanned per minute.

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE EMBODIMENT

Figure 1:
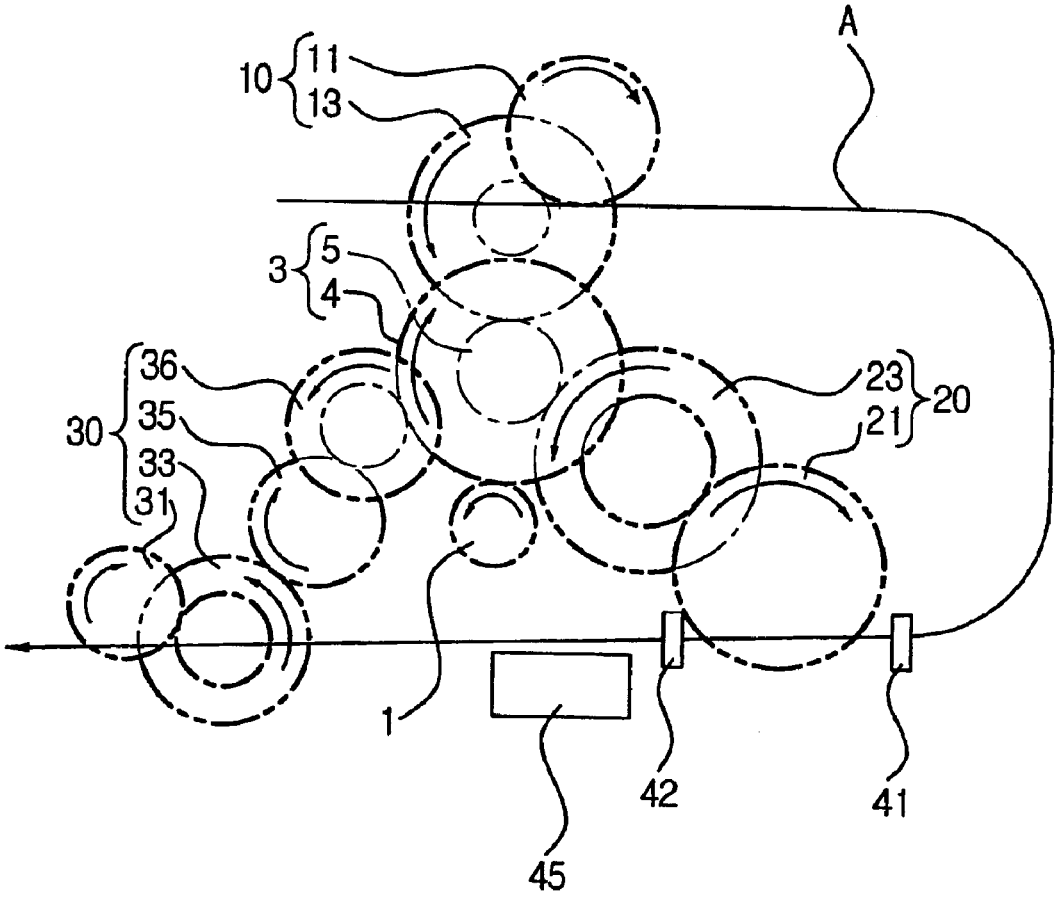
FIG. 1 (PRIOR ART)
FIG. 1 is a view of a conventional paper transferring mechanism.

Reference will now be made in detail to the present embodiments of the present invention, examples of which are illustrated in the accompanying drawings, wherein like reference numerals refer to like elements throughout.

Figure 2:
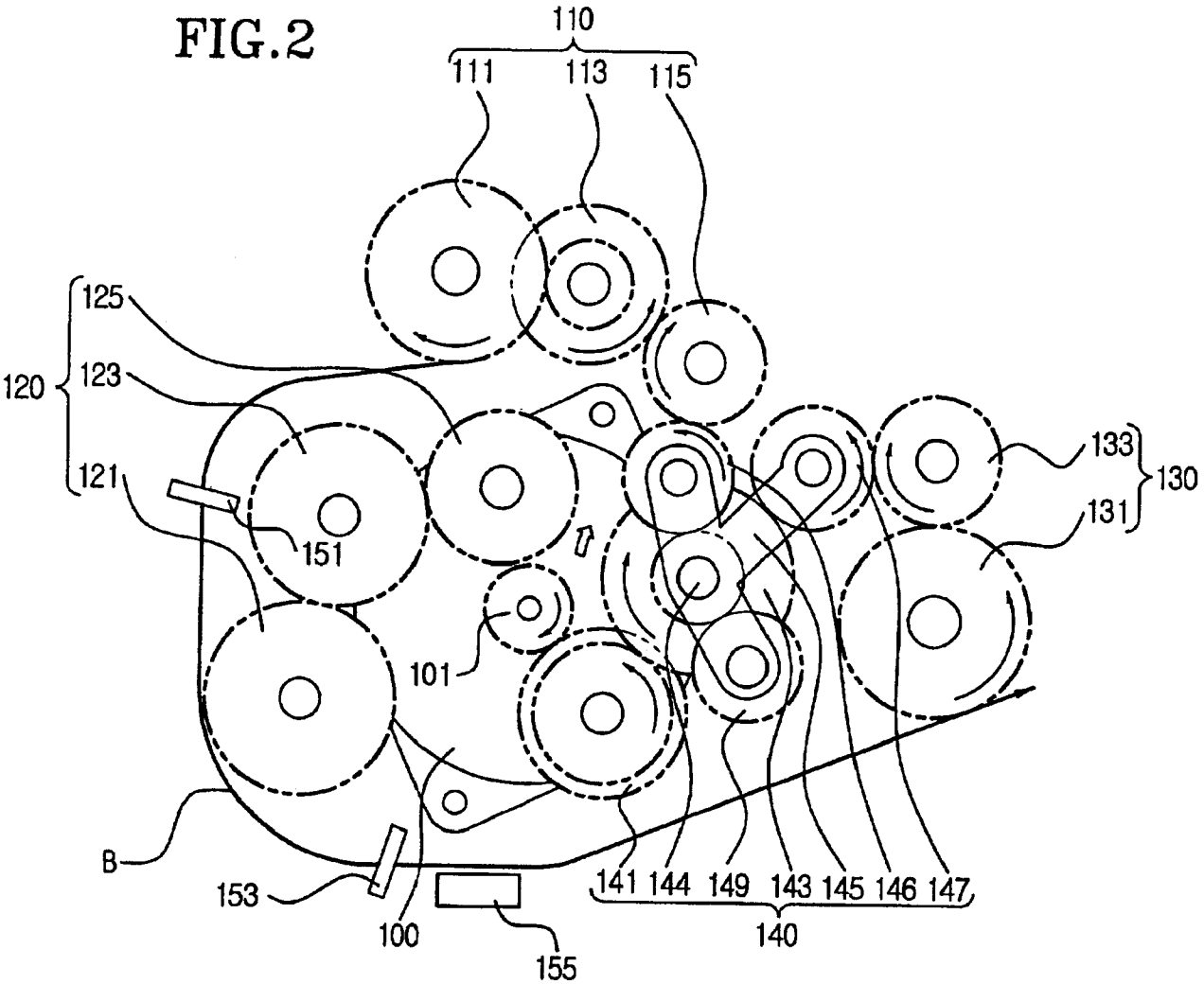
FIG. 2 is a view of a paper transferring mechanism adopting a swing gear, according to an embodiment of the present invention.

Referring to FIG. 2, a paper transferring mechanism adopting a swing gear, according to an embodiment of the present invention includes a motor 100, a pick-up gear train 110, a feed gear train 120, a discharge gear train 130, a swing gear train 140, a first sensor 151 and a second sensor 153.

The motor 100 is a power source which rotates a pick-up roller, a feed roller and a discharge roller (not shown in the drawings), and includes a drive gear 101 in its rotation shaft.

The pick-up gear train 110 transmits power to the pick-up roller, which separately picks up stacked paper sheets from a paper cassette to feed the paper sheets toward the feed roller. A pick-up gear 111 is coaxially coupled to a shaft of the pick-up roller. The pick-up gear 111 is meshed into a pick-up intermediate gear 113, which is meshed into a pick-up end gear 115. Preferably, the pick-up intermediate gear 113 is in a form of double gears, which have different sizes and are coaxially coupled to each other. The pick-up roller may utilize an ADF roller, which is used in a facsimile, etc.

The feed gear train 120 transmits power to the feed roller. The feed roller transfers to a scan unit 155 the paper sheet transferred from the pick-up roller via a paper transfer course B. A feed gear 121 is coaxially coupled with a shaft of the feed roller. The feed gear 121 is meshed into a feed intermediate gear 123, which is meshed into a feed end gear 125.

The discharge gear train 130 transmits power to the discharge roller to outwardly discharge the paper sheet after the paper sheet passes the scan unit 155. A discharge gear 131 is coupled with a shaft of the discharge roller. The discharge gear 131 is meshed into a discharge end gear 133.

A swing gear train 140 includes a swing end gear 141 meshed into the drive gear 101, a swing intermediate gear 143 meshed into the swing end gear 141, and a swing arm structure 145 disposed on a shaft 144 of the swing intermediate gear 143 and having three arms. The swing gear train 140 also includes first, second, and third swing gears 146, 147 and 149 disposed respectively on ends of the arms of the swing arm structure 145, and meshed into the swing intermediate gear 143.

The first swing gear 146 is selectively connected to one of the pick-up end gear 115 or the feed end gear 125 depending on a rotation direction of the motor. The second swing gear 147 is meshed into the discharge end gear 133 when the first swing gear 146 is connected to the pick-up end gear 115. The second swing gear 147 is also constructed to be idle when the first swing gear 146 is connected to the feed end gear 125. The third swing gear 149 is idle when the first swing gear 146 is connected to the pick-up end gear 115, and is meshed into the discharge gear 131 when the first swing gear 146 is connected to the feed end gear 125.

The first sensor 151 is disposed on the paper transfer course B between the pick-up roller and the feed roller, and activated by the paper sheet transferred from the pick-up roller.

The second sensor 153 is disposed on the paper transfer course B between the feed roller and the discharge roller, and activated by the paper sheet transferred from the feed roller. The second sensor 153 is preferably disposed between the feed roller and the scan unit 155 which is placed between the feed roller and the discharge roller.

An operation of the paper transferring mechanism utilizing the swing gear of the present invention as described above in reference to FIGS. 2 and 3, is described below.

When the drive gear 101 is rotated clockwise by the motor 100, the swing intermediate gear 143 is rotated clockwise via the swing end gear 141. The rotation of the swing intermediate gear 143 causes the swing arm structure 145 on the shaft of the swing intermediate gear 143 to pivot clockwise.

When the swing arm structure 145 pivots clockwise, the first swing gear 146 is connected to the pick-up end gear 115 and the second swing gear 147 is connected to the discharge end gear 133. Then, the pick-up gear 111 connected with the pick-up end gear 115 via the pick-up intermediate gear 113 is rotated clockwise as shown in FIG. 2. When the pick-up gear 111 is rotated clockwise, the pick-up roller coaxially coupled with the pick-up gear 111 picks up an upper-most one of the paper sheets stacked in the paper cassette to transfer the upper-most one of the paper sheets toward the feed roller.

Further, the discharge gear 131 meshed into the discharge end gear 133 is rotated counterclockwise as shown in FIG. 2. When the discharge gear 131 is rotated counterclockwise, the discharge roller coaxially coupled with the discharge gear 131 is also rotated counterclockwise to outwardly discharge the paper sheet introduced into the discharge roller. In this case, the feed roller is suspended since the feed end gear 125 is not connected to the first swing gear 146.

When the first sensor 151 is activated by a leading end of the paper sheet transferred by the pick-up roller, the motor 100 rotates counterclockwise. When the motor 100 rotates counterclockwise, the swing intermediate gear 143 is rotated counterclockwise by the drive gear 101 and the swing end gear 141. As the swing intermediate gear 143 is rotated counterclockwise, the swing arm structure 145 disposed on the shaft of the swing intermediate gear 143 also pivots counterclockwise.

When the swing arm structure 145 pivots counterclockwise, the first swing gear 146 is separated from the pick-up end gear 115 and connected with the feed end gear 125, while the second swing gear 147 becomes idle as it is separated from the discharge end gear 133. The third swing gear 149 is then connected to the discharge gear 131.

Figure 3:
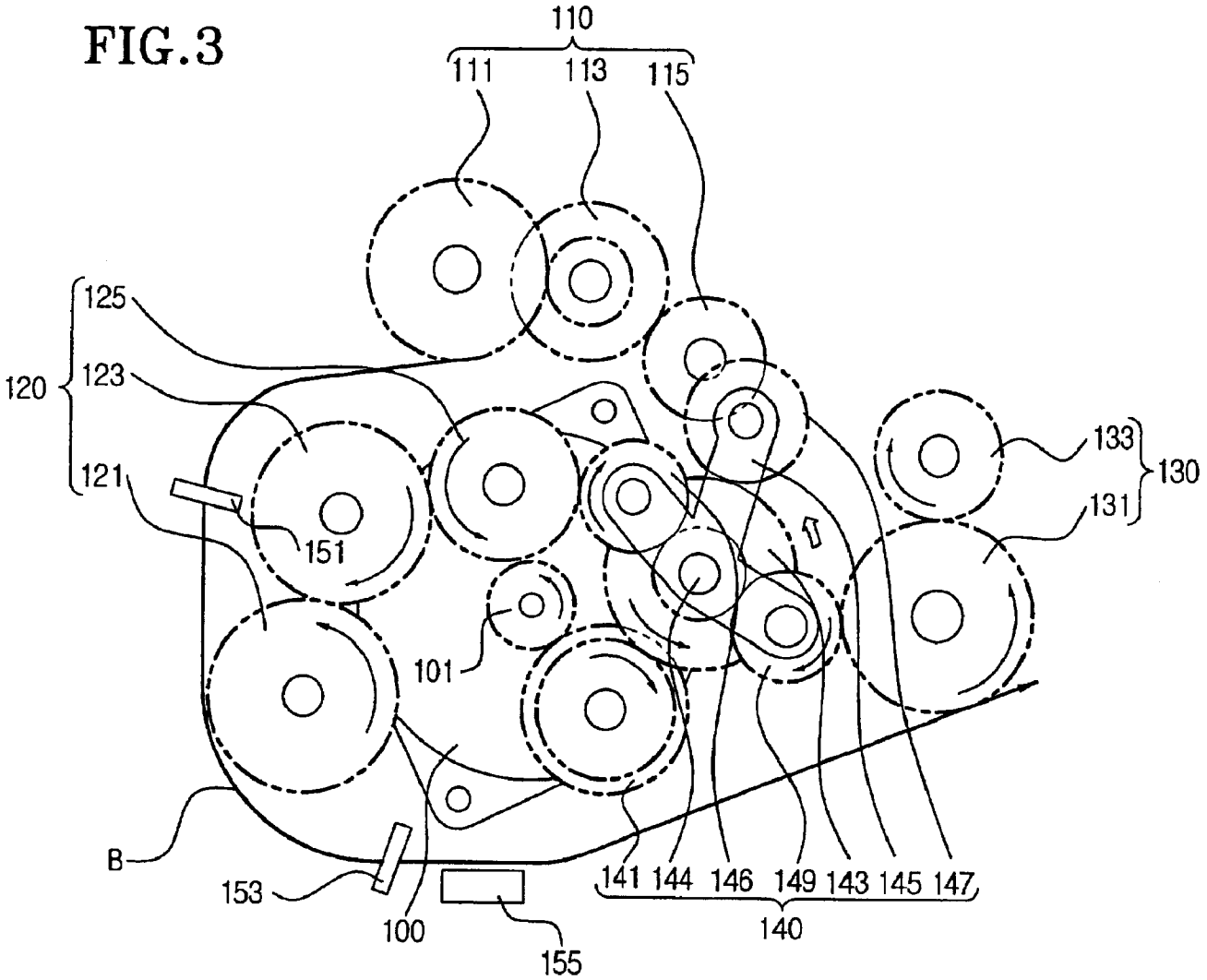
FIG. 3 is a view of the paper transferring mechanism shown in FIG. 2 in which a motor rotates in a reverse direction.

Then, the rotational force of the first swing gear 146 is transmitted into the feed gear 121 via the feed end gear 125 and the feed intermediate gear 123, so that the feed gear 121 is rotated counterclockwise as shown in FIG. 3. As the feed gear 121 is rotated counterclockwise, the feed roller coaxially connected with the feed gear 121 is also rotated counterclockwise to transfer the paper sheet fed via the pick-up roller toward the scan unit 155.

Since the third swing gear 149 is meshed into the discharge gear 131, the discharge gear 131 is rotated counterclockwise as shown in FIG. 3. Then, the discharge roller coaxially coupled with the discharge gear 131 continuously maintains its counterclockwise rotation identical with a circumstance in which the motor 100 rotates clockwise. Thus, the paper sheet introduced into the discharge roller via the paper transfer course B is outwardly discharged.

Since the pick-up end gear 115 is separated from the first swing gear 146, power is not transmitted into the pick-up end gear 115 from the motor 100 and this, causes the pick-up end gear 115 to maintain its suspended position so that no papers are picked up from the paper cassette.

After passing the feed roller, the leading end of the paper sheet enters the discharge roller after passing the second sensor 153 and the scan unit 155. When a predetermined time period necessary for a scanning operation lapses, based upon a time in which the second sensor 153 begins to operate and the rear end of the paper sheet passes the second sensor 153, the motor 100 rotates clockwise again.

When the motor 100 rotates clockwise, the swing arm 145 pivots clockwise so that the first swing gear 146 is connected to the pick-up end gear 115 rotating the pick-up roller. The third swing gear 149 is separated from the discharge gear 113 connected thereto and the second swing gear 147 is connected with the discharge end gear 133 so that the discharge roller maintains its counterclockwise rotation. Then, the pick-up roller picks up the upper-most one of the stacked paper sheets from the paper cassette and feeds the paper sheet to the feed roller. The paper sheet previously fed into the discharge roller is continuously discharged outward.

Figure 4:
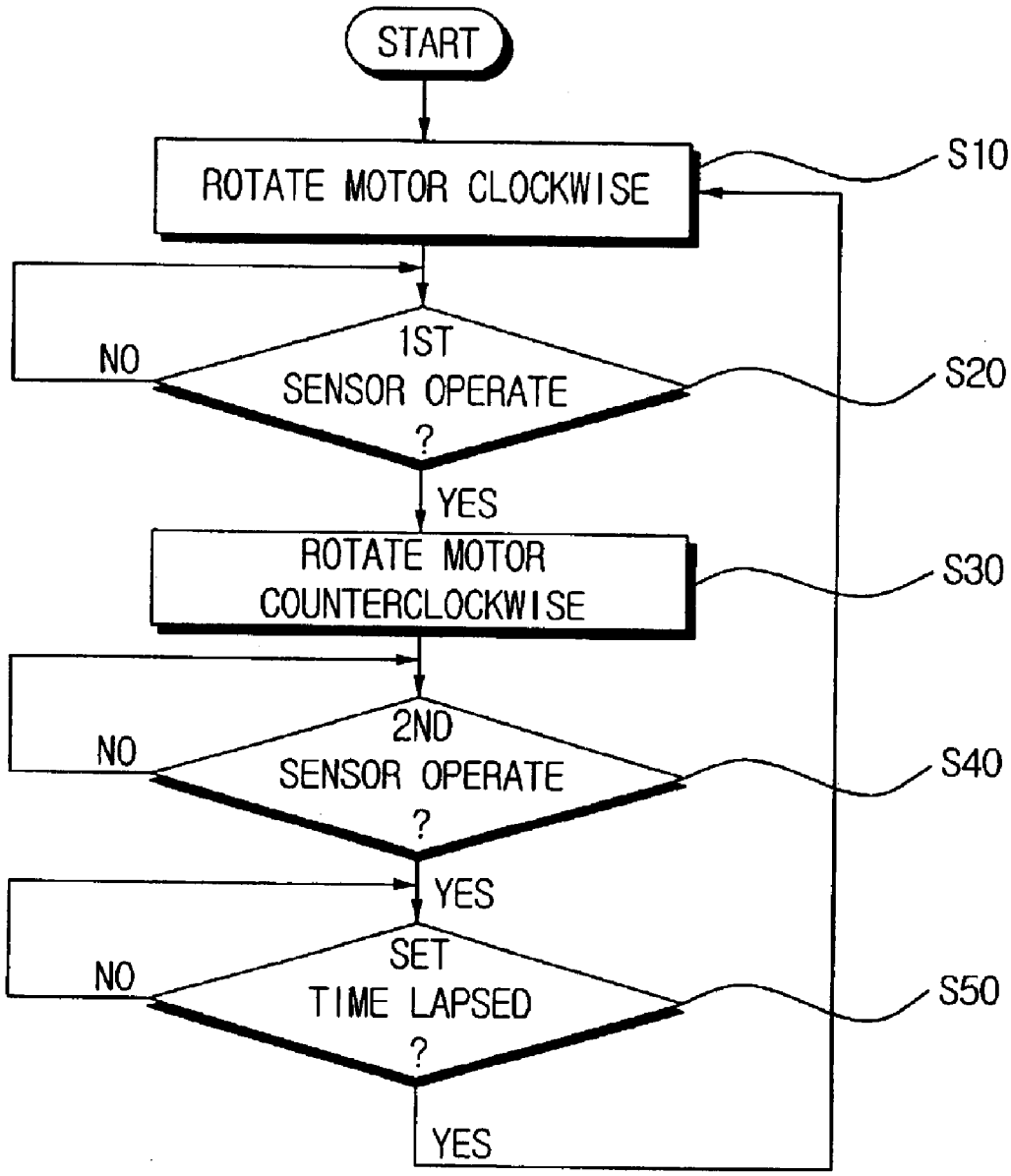
FIG. 4 is a flow chart of a process to control the paper transferring mechanism shown in FIG. 2.

The operation of the paper transferring mechanism using the above swing gear will be explained below with reference to FIG. 4.

First, a control unit rotates the motor 100 clockwise (operation S10). The control unit monitors whether the first sensor 151 operates, and if the first sensor 151 does not operate, the control unit successively rotates the motor 100 clockwise (S20). If the first sensor 151 operates, the control unit rotates the motor 100 counterclockwise (S30). The control unit monitors whether an operation signal is received from the second sensor 153 (S40). If the second sensor 153 does not operate, the motor 100 is allowed to maintain its counterclockwise rotation. If the second sensor 153 operates, the control unit calculates time from a time point in which the second sensor 153 begins to operate so as to judge whether a set time period has lapsed (S50). If the set time has not lapsed, the motor 100 is allowed to maintain its counterclockwise rotation. If the set time has lapsed, the motor 100 is allowed to rotate clockwise (S10), and the above-described operation is repeated.

Accordingly, the present invention allows the pick-up roller to implement a pick-up operation of a paper sheet before a previous paper sheet is completely discharged, reducing a pick-up interval between paper sheets.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A paper transferring mechanism to transfer a paper sheet, comprising:

a drive gear coaxially coupled with a rotation shaft of a motor;

a pick-up gear unit coupled with a shaft of a pick-up roller to feed the paper sheets;

a feed gear unit coupled with a shaft of a feed roller to outwardly transfer the paper sheets;

a discharge gear unit coupled with a shaft of a discharge roller to outwardly discharge the paper sheet;

a swing gear unit having one end connected to the drive gear and the other end selectively connected to one of the pick-up gear unit and the feed gear unit;

a first sensor disposed between the pick-up roller and the feed roller to detect the paper sheet; and a second sensor disposed between the feed roller and the discharge roller to detect the paper sheet, wherein a pick-up gear of the pick-up gear unit is rotated when the motor is rotated in a first direction, a feed gear of the feed gear unit is rotated when the motor is rotated in a second direction, the motor rotates in the second direction when the first sensor is activated, the motor rotates in the first direction when the second sensor is activated, and a discharge gear of the discharge gear unit is rotated constantly in one direction regardless of the rotation direction of the motor.

2. A paper transferring mechanism to transfer a paper sheet, comprising:

a drive gear coaxially coupled to a rotation shaft of a motor; a pick-up gear train to transmit power to a pick-up roller;

a feed gear train to transmit power to a feed roller;

a discharge gear train to transmit power to a discharge roller; and a swing gear train having one end connected to the drive gear and the other end selectively connected to one of the pick-up gear train and the feed gear train, a first sensor disposed between the pick-up roller and the feed roller to detect the paper sheet; and a second sensor disposed between the feed roller and the discharge roller to detect the paper sheets, wherein the pick-up roller is rotated when the motor rotates in a first direction, the feed roller is rotated when the motor rotates in a second direction, the motor rotates in the second direction when the first sensor is activated, the motor rotates in the first direction when the second sensor is activated, and the discharge roller is rotated constantly in one direction regardless of the rotation direction of the motor, to transfer the paper sheet.

3. The paper transferring mechanism in accordance with claim 2, wherein the pick-up gear train comprises:

a pick-up gear coaxially coupled with the pick-up roller;

a pick-up intermediate gear meshed into the pick-up gear; and a pick-up end gear meshed into the pick-up intermediate gear and connected with the swing gear train.

4. The paper transferring mechanism in accordance with claim 3, wherein the pick-up gear is in a form of a double gear.

5. The paper transferring mechanism in accordance with claim 2, wherein the feed gear train comprises:

a feed gear coaxially coupled with the feed roller;

a feed intermediate gear meshed into the feed gear; and a feed end gear meshed into the feed intermediate gear and connected with the swing gear train.

6. The paper transferring mechanism in accordance with claim 2, wherein the discharge gear train comprises:

a discharge gear coaxially coupled with the discharge gear; and a discharge end gear meshed into the discharge gear and connected with the swing gear train.

7. The paper transferring mechanism in accordance with claim 2, wherein the swing gear train comprises:

a swing end gear meshed into the drive gear;

a swing intermediate gear meshed into the swing end gear; a swing arm structure disposed coaxially with the swing intermediate gear and having three arms; and first, second, and third swing gears disposed, respectively, on ends of the arms of the swing arm structure to be meshed into the swing intermediate gear, wherein the first swing gear is connected with the pick-up gear train and the second swing gear is connected with the discharge gear train when the motor rotates in a first direction, and the first swing gear is connected with the feed gear train and the third swing gear is connected with the discharge gear train when the motor rotates in a second direction.

8. The paper transferring mechanism in accordance with claim 7, wherein the second swing gear is idle when the first swing gear is connected to a feed end gear of the feed gear train, and the third swing gear is idle when the first swing gear is connected to a pick-up end gear of the pick-up gear train.

9. The paper transferring mechanism in accordance with claim 7, wherein when the pick-up gear is separated from the first swing gear, power is not transmitted to the pick-up roller, causing the pick-up end gear to maintain a suspended position so that no paper is picked up by the pick-up gear train.

10. The paper transferring mechanism in accordance with claim 7, further comprising:

a control unit to calculate time from a time point in which the second sensor begins to operate to determine whether a predetermined time period lapses, wherein if the predetermined time does not lapse, the motor rotates in the second direction, and if the predetermined time period does lapse, the motor rotates in the first direction.

11. An office machine, comprising:

a feed unit having stacked paper sheets;

a motor having a rotation shaft coaxially coupled with a drive gear;

a pick-up roller powered by the motor via a pick-up gear train;

a feed roller powered by the motor via a feed gear train;

a discharge roller powered by the motor via a discharge gear train;

a swing gear train having one end connected with the drive gear and the other end selectively connected to one of the pick-up gear train and the feed gear train;

a first sensor disposed between the pick-up roller and the feed roller to detect a picked up one of the paper sheet;

a scan unit disposed between the feed roller and the discharge roller to read information from the picked up paper sheet; and a second sensor disposed between the feed roller and the scan unit to detect the picked up paper sheet, wherein rotation of the motor in a first direction causes the swing gear train to mesh into the pick-up gear train and the discharge gear train, which respectively rotates the pick-up roller and the discharge roller, so that the picked up paper sheet is transferred from the feed unit toward the feed roller, the motor rotates in a second direction when the picked up paper sheet passes the first sensor, the rotation of the motor in the second direction causes the swing gear train to reversely rotate and mesh into the feed gear and the discharge gear train to thereby, respectively rotate the feed roller and the discharge roller, and the motor rotates in the first direction again when an end of the picked up paper sheet passes the second sensor.

12. A controlling method of a paper transferring mechanism to selectively transmit power from a motor to one of a pick-up roller and a feed roller via a swing gear, the method comprising:

rotating the motor clockwise;

judging whether a first sensor operates;

if the first sensor operates, rotating the motor counter-clockwise;

judging whether a second sensor operates; and if the second sensor operates, rotating the motor clockwise.

13. The controlling method of a paper transferring mechanism in accordance with claim 12, further comprising:

judging whether a predetermined time period lapses after the second sensor is operated to determine a rotation direction of the motor.

14. A paper transferring mechanism having a drive gear coaxially coupled with a rotation shaft of a motor, comprising:

a pick-up gear unit to separately feed paper sheets;

a feed gear unit to outwardly transfer the picked up one of the paper sheets;

a discharge gear unit to outwardly discharge the picked up paper sheet;

a first sensor disposed between the pick-up gear unit and the feed gear unit, to detect the paper sheets; and a second sensor disposed between the feed gear unit and the discharge gear unit to detect the paper sheets, wherein a pick-up roller of the pick-up gear unit picks up a respective paper sheet before a previously picked up paper sheet is completely discharged from the discharge gear to reduce a pick-up interval between the paper sheets, the motor rotates in a first direction when the first sensor is activated, and the motor rotates in a second direction when the second sensor is activated.

15. A controlling method of a paper transferring mechanism to selectively transmit power from a motor to one of a pick-up roller and a feed roller via a swing gear, the method comprising:

rotating the motor in a first direction;

judging whether a first sensor operates;

if the first sensor operates, rotating the motor in a second direction, opposite the first direction;

judging whether a second sensor operates; and if the second sensor operates, rotating the motor in the first direction.

* * * * *